US007235338B2

(12) United States Patent
Takada et al.

(10) Patent No.: US 7,235,338 B2
(45) **Date of Patent: *Jun. 26, 2007**

(54) TONER AND IMAGE FORMING METHOD AND PROCESS CARTRIDGE FOR IMAGE FORMING APPARATUS USING THE TONER

(75) Inventors: Takeshi Takada, Numazu (JP); Masahiro Ohki, Numazu (JP); Toyoshi Sawada, Odawara (JP); Keiko Shiraishi, Susono (JP); Masashi Nagayama, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 175 days.

This patent is subject to a terminal disclaimer.

(21) Appl. No.: 10/879,746

(22) Filed: Jun. 30, 2004

(65) Prior Publication Data

US 2005/0008961 A1 Jan. 13, 2005

(30) Foreign Application Priority Data

Jun. 30, 2003 (JP) ..... 2003-188644

(51) Int. Cl.
*G03G 9/09* (2006.01)

(52) U.S. Cl. ..... 430/109.4; 430/124; 430/137.15

(58) Field of Classification Search ..... 430/108.1, 430/108.6, 109.4, 124, 137.15
See application file for complete search history.

(56) References Cited

U.S. PATENT DOCUMENTS

| | | | | |
|---|---|---|---|---|
| 5,541,037 | A | 7/1996 | Hatakeyama et al. | |
| 5,576,393 | A | 11/1996 | Yamashita et al. | |
| 6,074,795 | A | 6/2000 | Watanabe et al. | |
| 6,103,441 | A | 8/2000 | Tomita et al. | |
| 6,180,298 | B1 | 1/2001 | Kuroda et al. | |
| 6,363,229 | B1 | 3/2002 | Shiraishi et al. | |
| 6,566,026 | B2 | 5/2003 | Watanabe et al. | |
| 6,653,037 | B2 | 11/2003 | Sawada et al. | |
| 6,716,561 | B2 | 4/2004 | Shiraishi et al. | |
| 2003/0036010 | A1 | 2/2003 | Suzuki et al. | |
| 2003/0165765 | A1 | 9/2003 | Yamashita et al. | |
| 2005/0042534 | A1* | 2/2005 | Tanaka et al. | 430/108.4 |

FOREIGN PATENT DOCUMENTS

| | | |
|---|---|---|
| JP | 03-002276 | 1/1991 |
| JP | 05-088412 | 4/1993 |
| JP | 05-249742 | 9/1993 |
| JP | 06-019204 | 1/1994 |
| JP | 11-157843 | 6/1999 |
| JP | 11-189420 | 7/1999 |
| JP | 2000-319021 | 11/2000 |
| JP | 2002-129063 | 5/2002 |
| JP | 2002-189313 | 7/2002 |
| JP | 2002-196528 | 7/2002 |

* cited by examiner

*Primary Examiner*—John L Goodrow
(74) *Attorney, Agent, or Firm*—Oblon, Spivak, McClelland, Maier & Neustadt, P.C.

(57) ABSTRACT

A toner prepared by a method of dissolving or dispersing toner constituents comprising a modified resin capable of reacting with an active hydrogen and a colorant which is a black metallic material to prepare a solution or a dispersion; and reacting the solution or dispersion with at least one of a crosslinking agent and an elongation agent in an aqueous medium including a resin particulate material.

21 Claims, No Drawings

TONER AND IMAGE FORMING METHOD AND PROCESS CARTRIDGE FOR IMAGE FORMING APPARATUS USING THE TONER

BACKGROUND OF THE INVENTION

1. Field of the Invention

The present invention relates to a toner developing an electrostatic latent image formed on an image bearer to visualize the electrostatic latent image in electrophotography, electrostatic recording and electrostatic printing, and to a developer, an image forming method and a process cartridge for an image forming apparatus using the toner.

2. Discussion of the Background

As disclosed in U.S. Pat. No. 2,297,691, Japanese Patent Publications Nos. 49-23910 and 43-24748, electrophotographic image forming methods typically include forming an electrostatic latent image on a photoreceptor made from photoconductive materials by various means; developing the latent image with a developer to form a visual image; optionally transferring the visual image onto a receiving material such as a paper; and fixing the image thereon upon application of heat, pressure or solvent vapor. A full-color image is formed of a black-colored toner, a yellow-colored toner, a magenta-colored toner and a cyan-colored toner.

The black-colored toner typically includes carbon black as a colorant. However, recently, a trial of using a fine powder of a black metallic compound as a colorant instead of the carbon black is suggested. Japanese Patent No. 2736680 discloses a mixture of solid solutions of $Fe_2TiO_5$ and $Fe_2O_3$—$FeTiO_3$ having an average particle diameter of from 0.1 to 0.5 μm; Japanese Patents Nos. 3101782, 3108823 and 3174960 disclose a magnetic iron oxide including FeO by from 25 to 30%; Japanese Patents Nos. 3224774 and 3261088 disclose a magnetite having a residual magnetization not greater than6 emu/g; Japanese Laid-Open Patent Publication No. 2000-319021 discloses a particulate iron oxide having Ti inside and Ti and Fe on a surface thereof; Japanese Laid-Open Patent Publication No. 2002-129063 discloses a mixed phase crystal of a rutile type $TiO_2$, which is coated with $Fe_2TiO_4$, and which has a saturated magnetization of from 0.5 to 10 emu/g and a particle diameter of from 0.1 to 0.4 μm; Japanese Laid-Open Patent Publication No. 2002-189313 discloses a metallic compound having a saturation magnetization not greater than 30 emu/g and a dielectric loss factor not greater than 50; and Japanese Laid-Open Patent Publication No. 2002-196528 discloses a colorant including a metallic compound having a saturation magnetization not greater than 40 emu/g in an amount not greater than 20 parts by weight.

A black metallic compound having high safety and good fluidity as a colorant has a higher heat conductivity than the carbon black, and therefore resultant toner has a lower-temperature fixability. In addition, the black metallic compound has a higher specific gravity than the carbon black, and therefore the resultant toner can easily be mixed with a carrier in a developer. However, a metallic compound is not well dispersed in a toner prepared by a pulverization method and does not fully exert the best performance.

Because of these reasons, a need exists for a toner including a well-dispersed colorant and producing images having less background fouling and high definition.

SUMMARY OF THE INVENTION

Accordingly, an object of the present invention is to provide a toner including a well-dispersed colorant and producing images having less background fouling and high definition.

Another object of the present invention to provide an image forming method and a process cartridge for an image forming apparatus using the toner.

Briefly these objects and other objects of the present invention as hereinafter will become more readily apparent can be attained by a toner prepared by a method of dissolving or dispersing toner constituents comprising a modified resin capable of reacting with an active hydrogen and a colorant which is a black metallic material to prepare a solution or a dispersion; and reacting the solution or dispersion with at least one of a crosslinking agent and an elongation agent in an aqueous medium including a resin particulate material.

Further, the black metallic material preferably has a saturation magnetization of from 0 to 50 emu/g.

In addition, the black metallic material preferably has a lightness index L* not greater than 15, and chromaticness indices a* and b* of from −1.0 to +1.0 respectively, and wherein the lightness index L* and chromaticness indices a* and b* are determined by a method based on CIE1976.

These and other objects, features and advantages of the present invention will become apparent upon consideration of the following description of the preferred embodiments of the present invention.

DETAILED DESCRIPTION OF THE INVENTION

Generally, the present invention provides a toner including a well-dispersed colorant and producing images having less background fouling and high definition.

A black metallic material as a colorant can reduce carbon black having high conductivity imparting capability or eliminate the use thereof. Consequently, background fouling and toner scattering due to deterioration of chargeability of a toner and increase of reversely charged or weakly charged toner become difficult to occur.

Specific examples of the black metallic material include compounds, oxides and mixtures of a member selected from the group consisting of Mn, Ti, Cu, Si and C.

The black metallic material preferably has a saturation magnetization not greater than 50.0 emu/g. When the black metallic material preferably has a saturation magnetization not greater than 50.0 emu/g, the resultant toner has quite a small saturation magnetization. Therefore, when the toner is used as a non-magnetic toner, developability thereof does not deteriorate because a magnetic binding force thereof to a developer bearer in a one-component developer and to a carrier in a two-component developer does not increase.

As a standard of indicating blackness of the black metallic material, the black metallic material preferably has a lightness index L* of from 9 to 20, and chromaticness indices a* and b* of from −2.0 to +3.0 respectively. The lightness index L* and chromaticness indices a* and b* are determined by a method based on CIE1976. Particularly, the black metallic material more preferably has a lightness index L* not greater than 15, and chromaticness indices a* and b* of from −1.0 to +1.0 respectively so as to have sufficient colorability.

The black metallic material is preferably an iron oxide compound including titanium because of not being a material belonging to Pollutant Release and Transfer Register (PRTR). The compound is preferably a polycrystalline particulate powder including a solid solution of $Fe_2O_3$—Fe-$TiO_3$ in terms of being black and non-magnetic.

The compound preferably includes titanium components in an amount of from 10 to 45% by weight based on total weight of Fe. When less than 10% by weight, the resultant black pigment particulate powder has a larger magnetization. When greater than 45% by weight, the resultant black pigment particulate powder becomes non-magnetic, but has a high L* because $TiO_2$ is generated more.

The black metallic material preferably has a specific surface area of from 1.3 to 80 $m^2/g$, and more preferably from 1.5 to 30 $m^2/g$ in terms of its dispersibility in a toner. When greater than 80 $m^2/g$, the metallic material works as a filler and is difficult to contribute to low-temperature fixability of the resultant toner although depending on a content of the metallic material. When less than 1.3 $m^2/g$, the metallic material does not have sufficient colorability.

The black metallic material preferably has a true specific gravity of from 4.0 to 5.0 $g/cm^2$. The black metallic material having a true specific gravity of from 4.0 to 5.0 $g/cm^2$ properly increases a true specific gravity of the resultant toner. Therefore, the toner can efficiently be stirred with a carrier because of a small difference of specific gravities therebetween.

A toner preferably includes the black metallic material in an amount of from 10 to 50 parts by weight, and more preferably from 15 to 25 parts by weight per 100 parts by weight of a binder resin included in the toner. When less than 10 parts by weight, the black metallic material has less effect on low-temperature fixability of the resultant toner and less colorability. When greater than 50 parts by weight, dispersibility of the black metallic material in a toner deteriorates, resulting in deterioration of chargeability, developability and fixability of the resultant toner.

The black metallic material preferably has an average primary particle diameter of from 0.05 to 2.0 μm, and more preferably from 0.1 to 0.5 μm in terms of in terms of its dispersibility in a toner.

The black metallic material for use in the present invention can be prepared by calcining a magnetite particulate powder coated with titanium compound and a mixed powder of a magnetite particulate powder and a titanium compound or denitrified powder of a hematite particulate powder coated with a titanium compound at a temperature not less than 700° C. in an non-oxidizing atmosphere to prepare a calcined material, and pulverizing the calcined material. The magnetite particulate powder coated with titanium compound is preferably used in terms of non-magnetism because the resultant particulate material tends to have a small magnetization.

The magnetite particulate powder and hematite particulate powder may have any shape of a particle, a sphere or a needle, and further, have a size of from 0.03 to 1.5 μm.

A material size and a product size correlate with each other, and a material having a small size tends to produce a product having a small size while a material having a large size tends to produce a product having a large size.

As the titanium compound, any of hydrated oxides, hydrides and oxides of titanium can be used. A water-soluble titanium compound is preferably used when mixed with a magnetite particulate powder. The titanium compound preferably includes titanium components in an amount of from 10 to 45% by weight based on total weight of Fe. When less than 10% by weight, the resultant black pigment particulate powder has a larger magnetization. When greater than 45% by weight, the resultant black pigment particulate powder becomes non-magnetic, but has a high L* because $TiO_2$ is generated more.

$N_2$ gas and the like can be used as the non-oxidizing atmosphere. When an oxidizing atmosphere is used, a black iron oxide compound cannot be prepared.

The heating and calcining temperature needs to be 700° C. When less than 700° C., a solid-phase reaction of an iron oxide with a titanium compound is not fully performed to prepare a black pigment particulate powder.

The pulverization can be performed with a conventional pulverizer such as a ball mill, an attritor and a vibration mill.

In the above-mentioned method, material particles may optionally be coated with a known sintering inhibitor before heated and calcined. When the sintering inhibitor is used, a black pigment particulate powder having good dispersibility can be prepared because sintering of particles and particles one another can be prevented.

Specific examples of the sintering inhibitor include Al, Ti, Si, Zr and P. These can be used alone or in combination. The material particles are preferably coated with the sintering inhibitor in an amount of from 0.1 to 15.0% by weight based on total weight of Fe and Ti. When not less than 0.1% by weight, sintering is sufficiently inhibited. When greater than 15.0% by weight, magnetite is mixed in the resultant black pigment particulate powder and a non-magnetic black iron oxide compound becomes difficult to be prepared.

To increase blackness further, a black pigment or a cyan pigment is preferably fixed on a surface of the black pigment particulate powder with MECHANO Mill from OKADA SEIKO CO., LTD. or MECHANO FUSION SYSTEM from HOSOKAWA MICRON CORP. Specific examples of the black pigment include iron black, aniline black, graphite and fullerene. Specific examples of the cyan pigment include cobalt blue, alkali blue, Victoria Blue Lake, metal-free Phthalocyanine Blue, partially-chlorinated Phthalocyanine Blue, Fast Sky Blue and Indanthrene Blue BC. However, specific examples of the black pigment and cyan pigment are not limited thereto.

A resin preferably used in the present invention is a modified polyester resin with a group capable of performing urea-bonding (RMPE). Specific examples of the RMPE include a polyester prepolymer having an isocyanate group (A). The polyester prepolymer having an isocyanate group (A) can be prepared by reacting a polyester resin having an active hydrogen atom, which is formed by polycondensation between polyol (PO) and a polycarboxylic acid (PC), with polyisocyanate (PIC).

Specific examples of the group including an active hydrogen include hydroxyl groups (alcoholic hydroxyl groups and a phenolic hydroxyl groups), amino groups, carboxyl groups, mercapto groups, etc. In particular, the alcoholic hydroxyl group is preferably used. It is easy to control a molecular weight of a polymer of a modified polyester (MPE), and therefore the MPE is preferably used to particularly impart oilless low-temperature fixability (wide releasability and fixability without applying a release oil to a heating medium fixing a toner) to a dry toner.

As the polyol (PO), diol (DIO) and triol (TO) can be used, and the DIO alone or a mixture of the DIO and a small amount of the TO is preferably used.

Specific examples of the diol include alkylene glycol such as ethylene glycol, 1,2-propylene glycol, 1,3-propylene glycol, 1,4-butanediol, and 1,6-hexanediol; alkylene ether glycol such as diethylene glycol, triethylene glycol, dipropylene glycol, polyethylene glycol, polypropylene glycol and polytetramethylene ether glycol; alicyclic diol such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide.

In particular, alkylene glycol having 2 to 12 carbon atoms and adducts of bisphenol with an alkylene oxide are preferably used, and a mixture thereof is more preferably used.

Specific examples of the triol include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide.

As the polycarbonate (PC), dicarboxylic acid (DIC) and tricarboxylic acid (TC) can be used. The DIC alone, or a mixture of the DIC and a small amount of the TC are preferably used.

Specific examples of the dicarboxylic acid include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used.

Specific examples of the tricarboxylic acid include aromatic polycarboxylic acids having 9 to 20 carbon atoms such as trimellitic acid and pyromellitic acid. The polycarboxylic acid can be formed from a reaction between the polyol and the above-mentioned acids anhydride or lower alkyl ester such as methyl ester, ethyl ester and isopropyl ester.

The PO and PC are mixed such that an equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

Specific examples of the PIC include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; aromatic diisocyanate such as tolylenedisocyanate and diphenylmethanediisocyanate; aroma aliphatic diisocyanate such as α, α, α', α'-tetramethylxylylenediisocyanate; isocyanurate; the above-mentioned polyisocyanate blocked with phenol derivatives, oxime and caprolactam; and their combinations.

When the polyester prepolymer having an isocyanate group, the PIC is mixed with polyester such that an equivalent ratio ([NCO]/[OH]) between an isocyanate group [NCO] and a polyester resin having a hydroxyl group [OH] is typically from 5/1 to 1/1, preferably from 4/1 to 1.2/1 and more preferably from 2.5/1 to 1.5/1. When [NCO]/[OH] is greater than 5, low-temperature fixability of the resultant toner deteriorates.

A content of the PIC in the polyester prepolymer having an isocyanate group A is from 0.5 to 40% by weight, preferably from 1 to 30% by weight and more preferably from 2 to 20% by weight. When less than 0.5% by weight, hot offset resistance, thermostable preservability and low-temperature fixability of the resultant toner deteriorate. When greater than 40% by weight, low-temperature fixability thereof deteriorates. The polyester prepolymer having an isocyanate group A preferably includes not less than 2, more preferably from 2 to 3, and furthermore preferably from 2.01 to 2.5 isocyanate groups in a molecule.

Any known cross-linkers and elongation agents can be used in the present invention. An active hydrogen compound capable of reacting with a reactive group such as an isocyanate group, particularly amines are preferably used as the cross-linkers and elongation agents for a modified polyester.

Specific examples of the amines (B) include diamines (B1), polyamines (B2) having three or more amino groups, amino alcohols (B3), amino mercaptans (B4), amino acids (B5) and blocked amines (B6) in which the amines (B1 to B5) mentioned above are blocked.

Specific examples of the diamines (B1) include aromatic diamines such as phenylene diamine, diethyltoluene diamine and 4,4'-diaminodiphenyl methane; alicyclic diamines such as 4,4'-diamino-3,3'-dimethyldicyclohexyl methane and diaminocyclohexane and isophorondiamine); aliphatic diamines such as ethylene diamine, tetramethylene diamine and hexamethylene diamine; etc.

Specific examples of the polyamines (B2) having three or more amino groups include diethylene triamine, triethylene tetramine.

Specific examples of the amino alcohols (B3) include ethanol amine and hydroxyethyl aniline. Specific examples of the amino mercaptan (B4) include aminoethyl mercaptan and aminopropyl mercaptan.

Specific examples of the amino acids (B5) include amino propionic acid and amino caproic acid.

Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc.

Among these amines (B), diamines (B1) and mixtures in which a diamine is mixed with a small amount of a polyamine (B2) are preferably used.

In the present invention, not only the modified polyester (MPE) alone but also the unmodified polyester (PE) can be included in a toner as a toner binder with the modified polyester (MPE). A combination thereof improves low-temperature fixability of the resultant toner and glossiness of color images produced thereby, and the combination is more preferably used than using the modified polyester (MPE) alone. Suitable unmodified polyester (PE) includes similar polycondensation products of the polyol (PO) and polycarboxylic acid (PC) used for the modified polyester (MPE) and specific examples thereof are the same as those of the modified polyester (MPE).

In addition, it is preferable that the MPE and PE are partially mixed with each other to improve low-temperature fixability and hot offset resistance of the resultant toner. Therefore, the MPE preferably has a similar composition to that of the PE. A mixing ratio between the MPE and PE is from 5/95 to 80/20, preferably from 5/95 to 30/70, more preferably from 5/95 to 25/75, and even more preferably from 7/93 to 20/80. When the MPE is less than 5%, hot offset resistance, thermostable preservability and low-temperature fixability of the resultant toner deteriorate.

The PE typically has a peak molecular weight of from 1,000 to 30,000, preferably from 1,500 to 10,000, and more preferably from 2,000 to 8,000. When less than 1,000, thermostable preservability of the resultant toner deteriorates. When greater than 10,000, low-temperature fixability thereof deteriorates.

The PE preferably has a hydroxyl value not less than 5, more preferably of from 10 to 120, and furthermore preferably of from 20 to 80. When less than 5, thermostable preservability and low-temperature fixability of the resultant toner deteriorate. The PE preferably has an acid value of from 1 to 30, and more preferably from 5 to 20. The PE having such an acid value tends to be negatively charged.

In the present invention, the toner binder preferably has a glass transition temperature (Tg) of from 50 to 70° C., and more preferably of from 55 to 65° C. When the glass transition temperature is less than 50° C., thermostable preservability of the resultant toner deteriorates. When greater than 70° C., low-temperature fixability thereof becomes insufficient.

The toner binder preferably has a temperature (TG') not less than 100° C., and more preferably of from 110 to 200° C. at which storage modulus thereof is 10,000 dyne/cm$^2$ at a measuring frequency of 20 Hz. When less than 100° C., hot offset resistance of the resultant toner deteriorates. The toner binder preferably has a temperature (Tη) not greater than 180° C., and more preferably of from 90 to 160° C. at which viscosity thereof is 1,000 poise at a measuring frequency of 20 Hz. When greater than 180° C., low-temperature fixability of the resultant toner deteriorates.

Namely, TG' is preferably higher than Tη in terms of compatibility between the hot offset resistance and low-temperature fixability, i.e., a difference between TG' and Tη (TG'−Tη) is preferably not less than 0° C., more preferably not less than 10° C., and furthermore preferably not less than 20° C. An upper limit of the difference is not particularly limited. In addition, in terms of compatibility between thermostable preservability and low temperature fixability, a difference between Tη and Tg is preferably from 0 to 100° C., more preferably from 10 to 90° C., and furthermore preferably from 20 to 80° C.

The toner of the present invention can be prepared by the following method, but is not limited thereto.

The aqueous medium for use in the present invention include water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone.

The toner of the present invention can be prepared by reacting a dispersion formed of the prepolymer (A) having an isocyanate group with (B). As a method of stably preparing a dispersion formed of the prepolymer (A) in an aqueous medium, a method of including toner constituents into an aqueous medium and dispersing them upon application of shear force is preferably used. The prepolymer (A) and other toner constituents such as colorants, master batch pigments, release agents, charge controlling agents, unmodified polyester resins, etc. may be added into an aqueous medium at the same time when the dispersion is prepared. However, it is preferable that the toner constituents are previously mixed and then the mixed toner constituents are added to the aqueous liquid at the same time. In addition, colorants, release agents, charge controlling agents, etc., are not necessarily added to the aqueous dispersion before particles are formed, and may be added thereto after particles are prepared in the aqueous medium. A method of dyeing particles previously formed without a colorant by a known dying method can also be used.

The dispersion method is not particularly limited, and low speed shearing methods, high-speed shearing methods, friction methods, high-pressure jet methods, ultrasonic methods, etc. can be used. Among these methods, high-speed shearing methods are preferably used because particles having a particle diameter of from 2 to 20 μm can be easily prepared. At this point, the particle diameter (2 to 20 μm) means a particle diameter of particles including a liquid). When a high-speed shearing type disperser is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes.

A temperature in the dispersion process is typically from 0 to 150° C. (under pressure), and preferably from 40 to 98° C.

When the temperature is relatively high, the prepolymer (A) can easily be dispersed because the dispersion formed thereof has a low viscosity.

A content of the aqueous medium to 100 parts by weight of the toner constituents including the prepolymer (A) is typically from 50 to 2,000 parts by weight, and preferably from 100 to 1,000 parts by weight. When the content is less than 50 parts by weight, the dispersion of the toner constituents in the aqueous medium is not satisfactory, and thereby the resultant mother toner particles do not have a desired particle diameter. In contrast, when the content is greater than 2,000, the production cost increases. A dispersant can preferably be used to prepare a stably dispersed dispersion including particles having a sharp particle diameter distribution.

To synthesize a modified polyester such as urea-modified polyester from the prepolymer (A), the amines (B) may be added to the toner constituents before dispersed in an aqueous medium or after dispersed. In this case, the urea-modified polyester is formed on a surface of the toner by priority and a concentration gradient can be formed in particles.

Specific examples of the dispersants used to emulsify and disperse an oil phase for a liquid including water in which the toner constituents are dispersed include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di(octylaminoethyle)glycin, and N-alkyl-N,N-dimethylammonium betaine.

In addition, a surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4)sulfonate, sodium 3-{omega-fluoroalkanoyl (C6-C8)-N-ethylamino}-1-propanesulfonate, fluoroalkyl (C11-C20)carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl (C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and204, which are manufactured by Tohchem Products Co., Ltd.; FUTARGENT F-100 and F150 manufactured by Neos; etc.

Specific examples of the cationic surfactants, which can disperse an oil phase including toner constituents in water, include primary, secondary and tertiary aliphatic amines having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, imidazolinium salts, etc.

Specific examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

In addition, inorganic compound dispersants such as tricalcium phosphate, calcium carbonate, titanium oxide, colloidal silica and hydroxyapatite which are hardly insoluble in water can also be used.

Further, it is possible to stably disperse toner constituents in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When an acid such as calcium phosphate or a material soluble in alkaline is used as a dispersant, the calcium phosphate is dissolved with an acid such as a hydrochloric acid and washed with water to remove the calcium phosphate from the toner particle. Besides this method, it can also be removed by an enzymatic hydrolysis. When a dispersant is used, the dispersant may remain on a surface of the toner particle.

Further, to decrease viscosity of a dispersion medium including the toner constituents, a solvent which can dissolve the modified polyester such as urea-modified polyester or prepolymer (A) can preferably be used because the resultant particles have a sharp particle diameter distribution.

The solvent is preferably volatile and has a boiling point lower than 100° C. because of easily removed from the dispersion after the particles are formed. Specific examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used.

An addition quantity of such a solvent is from 0 to 300 parts by weight, preferably from 0 to 100, and more preferably from 25 to 70 parts by weight, per 100 parts by weight of the prepolymer (A) used. When such a solvent is used to prepare a particle dispersion, the solvent is removed therefrom under a normal or reduced pressure after the particles are subjected to an elongation reaction and/or a crosslinking reaction of the prepolymer with amine.

The elongation and/or crosslinking reaction time depend on reactivity of an isocyanate structure of the prepolymer (A) and amine (B), but is typically from 10 min to 40 hrs, and preferably from 2 to 24 hrs.

In addition, the reaction temperature is typically from 0 to 150° C., and preferably from 40 to 98° C. In addition, a known catalyst such as dibutyltinlaurate and dioctyltinlaurate can be used.

To remove an organic solvent from an emulsified dispersion, a method of gradually raising a temperature of the whole dispersion to completely remove the organic solvent in the droplet by vaporizing can be used. Otherwise, a method of spraying the emulsified dispersion in a dry air, completely removing a water-insoluble organic solvent in the droplet to form toner fine particles and removing a water dispersant by vaporizing can also be used.

As the dry air, an atmospheric air, a nitrogen gas, carbon dioxide gas, a gaseous body in which a combustion gas is heated, and particularly various aerial currents heated to have a temperature not less than a boiling point of a solvent used are typically used. A spray dryer, a belt dryer and a rotary kiln can sufficiently remove the organic solvent in a short time.

When an emulsified dispersion is washed and dried while maintaining a wide particle diameter distribution thereof, the dispersion can be classified to have a desired particle diameter distribution.

A cyclone, a decanter, a centrifugal separation, etc. can remove fine particles in a dispersion liquid. A powder after the dispersion liquid is dried can be classified, but the liquid is preferably classified in terms of efficiency. Unnecessary fine and coarse particles can be recycled to a kneading process to form particles. The fine and coarse particles may be wet when recycled.

A dispersant used is preferably removed from a dispersion liquid, and preferably removed and classified at the same time.

Heterogeneous particles such as release agent fine particles, charge controlling fine particles, fluidizing fine particles and colorant fine particles can be mixed with a toner powder after dried. Release of the heterogeneous particles from composite particles can be prevented by giving a mechanical stress to a mixed powder to fix and fuse them on a surface of the composite particles.

Specific methods include a method of applying an impact strength on a mixture with a blade rotating at a high-speed, a method of putting a mixture in a high-speed stream and accelerating the mixture such that particles thereof collide each other or composite particles thereof collide with a collision board, etc. Specific examples of the apparatus include an ONG MILL from Hosokawa Micron Corp., a modified I-type mill having a lower pulverizing air pressure from Nippon Pneumatic Mfg. Co., Ltd., a hybridization system from Nara Machinery Co., Ltd., a Kryptron System from Kawasaki Heavy Industries, Ltd., an automatic mortar, etc.

The toner of the present invention may include a wax together with a binder resin and a colorant. Specific examples of the wax include known waxes, e.g., polyolefin waxes such as polyethylene wax and polypropylene wax; long chain carbon hydrides such as paraffin wax and sasol wax; and waxes including carbonyl groups. Among these waxes, the waxes including carbonyl groups are preferably used. Specific examples thereof include polyesteralkanate such as carnauba wax, montan wax, trimethylolpropanetribehenate, pentaelislitholtetrabehenate, pentaelislitholdiacetatedibehenate, glycerinetribehenate and 1,18-octadecanedioldistearate; polyalkanolesters such as tristearyltrimellitate and distearylmaleate; polyamidealkanate such as ethylenediaminebehenylamide; polyalkylamide such as tristearylamidetrimellitate; and dialkylketone such as distearylketone. Among these waxes including a carbonyl group, polyesteralkanate is preferably used.

The wax for use in the present invention usually has a melting point of from 40 to 160° C., preferably of from 50 to 120° C., and more preferably of from 60 to 90° C. A wax having a melting point less than 40° C. has an adverse effect on its high temperature preservability, and a wax having a melting point greater than 160° C. tends to cause cold offset of the resultant toner when fixed at a low temperature. In addition, the wax preferably has a melting viscosity of from 5 to 1,000 cps, and more preferably of from 10 to 100 cps when measured at a temperature higher than the melting point by 20° C. A wax having a melting viscosity greater than 1,000 cps makes it difficult to improve hot offset resistance and low temperature fixability of the resultant toner.

A content of the wax in a toner is preferably from 0 to 40% by weight, and more preferably from 3 to 30% by weight.

The toner of the present invention may optionally include a charge controlling agent. Materials almost colorless or white are preferably used because colored materials cause a color change of the resultant toner. Specific examples of the charge controlling agent include known charge controlling agents such as triphenylmethane dyes, chelate compounds of molybdic acid, Rhodamine dyes, alkoxyamines, quaternary ammonium salts (including fluorine-modified quaternary ammonium salts), alkylamides, phosphor or compounds including phosphor, tungsten or compounds including tungsten, fluorine-containing activators, metal salts of salicylic acid, salicylic acid derivatives, etc.

Specific examples of the marketed products of the charge controlling agents include BONTRON P-51 (quaternary ammonium salt), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

A content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images.

These charge controlling agent can be dissolved and dispersed after kneaded upon application of heat together with a master batch pigment and a resin, can be added when directly dissolved and dispersed in an organic solvent or can be fixed on a toner surface after the toner particles are produced.

As a fine particulate resin for use in the present invention, any thermoplastic and thermosetting resins can be used provided they can form an aqueous dispersion. Specific examples of the resins include vinyl resins, polyurethane resins, epoxy resins, polyester resins, polyamide resins, polyimide resins, silicon resins, phenol resins, melamine resins, urea resins, aniline resins, ionomer resins and polycarbonate resins. These resins can be used in combination.

Among these resins, the vinyl resins, polyurethane resins, epoxy resins, polyester resins and their combinations are preferably used because an aqueous dispersion of a fine spheric particulate resin can easily be prepared.

Specific examples of the vinyl resins include polymers formed of homopolymerized or copolymerized vinyl monomers such as styrene-(metha)esteracrylate resins, styrene-butadiene copolymers, (metha)acrylic acid-esteracrylate polymers, styrene-acrylonitrile copolymers, styrene-maleic acid anhydride copolymers and styrene-(metha)acrylic acid copolymers.

As an external additive for improving fluidity, developability and chargeability of the colored particles of the present invention, inorganic fine particles are preferably used. The inorganic fine particles preferably have a primary particle diameter of from 5 nm to 2 μm, and more preferably from 5 nm to 500 nm. In addition, a specific surface area of the inorganic fine particles measured by a BET method is preferably from 20 to 500 $m^2/g$. The content of the external additive is preferably from 0.01 to 5% by weight, and more preferably from 0.01 to 2.0% by weight, based on total weight of the toner composition.

Specific examples of the inorganic fine particles include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Other than these materials, polymer fine particles such as polystyrene formed by a soap-free emulsifying polymerization, a suspension polymerization or a dispersing polymerization, estermethacrylate or esteracrylate copolymers, silicone resins, benzoguanamine resins, polycondensation fine particles such as nylon and polymer particles of thermosetting resins can be used.

These fluidizers, i.e., surface treatment agents can increase hydrophobicity and prevent deterioration of fluidity and chargeability of the resultant toner even in high humidity. Specific examples of the surface treatment agents include silane coupling agents, sililating agents, silane coupling agents having an alkyl fluoride group, organic titanate coupling agents, aluminium coupling agents silicone oils and modified silicone oils.

The toner of the present invention may include a cleanability improver for removing a developer remaining on a photoreceptor and a first transfer medium after transferred. Specific examples of the cleanability improver include fatty acid metallic salts such as zinc stearate, calcium stearate and stearic acid; and polymer fine particles prepared by a soap-free emulsifying polymerization method such as polymethylmethacrylate fine particles and polystyrene fine particles. The polymer fine particles comparatively have a narrow particle diameter distribution and preferably have a volume-average particle diameter of from 0.01 to 1 μm.

The toner of the present invention preferably has a specific shape and a distribution thereof. An amorphous toner having an average circularity less than 0.90 and being too far from a sphere does not have sufficient transferability and produce high quality images without toner scattering.

As a method of measuring the shape, an optical detecting belt passing a suspension liquid including a particulate material through a plate image detecting belt and optically detecting an image of the particulate material with a CCD camera is preferably used. The circularity is a value calculated by dividing a circumferential length of a circle having an equivalent area to a projected area obtained by this method with a circumferential length of an actual particulate material.

A toner having an average circularity of from 0.94 to 0.96 is effectively used to form fine images with proper density. The toner preferably has an average circularity of from 0.945 to 0.955, and not greater than 10% of particles having a circularity less than 0.94.

When a toner having an average circularity not less than 0.96 is used in an apparatus using a blade for cleaning, a photoreceptor and a transfer belt therein are poorly cleaned to produce foul images. For example, an amount of a residual toner after transferred is small when an image having a low image area ratio is developed and transferred, and therefore the photoreceptor and transfer belt are not poorly cleaned. However, the residual toner occasionally remains thereon when an image having a high image area ration such as a photograph image is produced and an untransferred toner image is formed thereon because a paper is defectively fed to cause background fouling of images when accumulated. Further, the residual toner contaminates a charging roller contacting the photoreceptor, and the charging roller is unable to perform its original chargeability.

The toner of the present invention preferably has a weight-average particle diameter of from 4 to 8 μm and a ratio thereof to a number-average particle diameter thereof not greater than 1.25, and more preferably of from 1.10 to 1.25. Such a toner produces images having good glossiness when used in a full-color copier. Further, when used in a two-component developer, even after the toner is consumed and fed for long periods, the toner particle diameter has less variation. In addition, even after agitated in an image developer for long periods, the toner has good and stable developability. When used in a one-component developer, even after the toner is consumed and fed for long periods, toner filming over a developing roller and toner adherence over a blade for making a thin layer of the toner do not occur. In addition, even after agitated in an image developer for long periods, the toner has good and stable developability.

Typically, the less the particle diameter of the toner, the more advantageous to produce high resolution and quality images. However, it is disadvantageous for transferability and cleanability. When the Dv is less than the above-mentioned range, the toner in a two-component developer adheres to a surface of a carrier due to a long agitation in an image developer, resulting in deterioration of chargeability of the carrier. The toner in a one-component developer tends to cause filming over a developing roller and adhere to a member such as a blade.

These phenomena also occur when a content of fine particles in a toner is greater than the above-mentioned range.

When the Dv is greater than the above-mentioned range, the Dv tends to vary much and it is difficult to produce high resolution and quality images. In addition, when Dv/Dn is greater than 1.25, a similar problem occurs.

The toner of the present invention can be used for a two-component developer in which the toner is mixed with a magnetic carrier. A content of the toner is preferably from 1 to 10 parts by weight per 100 parts by weight of the carrier.

Suitable carriers for use in the two component developer include known carrier materials such as iron powders, ferrite powders, magnetite powders, magnetic resin carriers, which have a particle diameter of from about 20 to about 200 μm.

A surface of the carrier may be coated by a resin. Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

An electroconductive powder may optionally be included in the toner. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control an electric resistance of the resultant toner.

The toner of the present invention can also be used as a one-component magnetic developer or a one-component non-magnetic developer without using a carrier. The one-component magnetic or non-magnetic developer can be filled in a container.

The one-component or two-component developer of the present invention can be placed in an image developer of a process cartridge. The process cartridge of the present invention includes an image bearer such as an electrophotographic photoreceptor and at least an image developer.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis of Organic Particulate Emulsion 683 parts of water, 11 parts of a sodium salt of an adduct of a sulfuric ester with ethyleneoxide methacrylate (ELEMINOL RS-30 from Sanyo Chemical Industries, Ltd.), 138 parts of styrene, 138 parts of methacrylate and 1 part of persulfate ammonium were mixed in a reaction vessel including a stirrer and a thermometer, and the mixture was stirred for 15 min at 400 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was left for 5 hrs at 75° C. to prepare an aqueous dispersion [a particulate dispersion 1] of a vinyl resin (a copolymer of a sodium salt of an adduct of styrene-methacrylate-butylacrylate-sulfuric ester with ethyleneoxide methacrylate).

Preparation for Aqueous Phase 990 parts of water, 80 parts of the particulate dispersion 1, 40 parts of an aqueous solution of sodium dodecyldiphenyletherdisulfonate having a concentration of 48.5% (ELEMINOL MON-7 from Sanyo Chemical Industries, Ltd.) and 90 parts of ethyl acetate were mixed and stirred to prepare a lacteous liquid [aqueous phase 1].

Synthesis of Low-molecular-weight Polyester 220 parts of an adduct of bisphenol A with 2 moles of ethyleneoxide, 561 parts of an adduct of bisphenol A with 3 moles of propyleneoxide, 218 parts terephthalic acid, 48 parts of adipic acid and 2 parts of dibutyltinoxide were mixed and reacted in a reactor vessel including a cooling pipe, a stirrer and a nitrogen lead-in pipe for 8 hrs under a normal pressure at 230° C. Further, after the mixture was depressurized by 10 to 15 mm Hg and reacted for 5 hrs, 45 parts of trimellitic acid anhydride was added thereto and reacted for 2 hrs at 180° C. under a normal pressure to prepare a [low-molecular-weight polyester 1].

Synthesis of Prepolymer 410 parts of the low-molecular-weight polyester 1, 89 parts of isophoronediisocyanate and 500 parts of ethyl acetate were reacted in a reactor vessel including a cooling pipe, a stirrer and a nitrogen lead-in pipe for 5 hrs at 100° C. to prepare a [prepolymer 1].

Synthesis of Ketimine Compound 170 parts of isophorondiamine and 75 parts of methyl ethyl ketone were reacted at 50° C. for 5 hrs in a reaction vessel including a stirrer and a thermometer to prepare a [ketimine compound 1].

Synthesis of Master Batch 1,200 parts of water, 870 parts of metallic material 3 (Table 1), 870 parts of a polyester resin were mixed in a Henschel mixer from Mitsui Mining Co., Ltd. to prepare a mixture. After the mixture was kneaded with a two-roll mill at 150° C. for 30 min, the mixture was rolled upon application of pressure, cooled and pulverized by a pulverizer to prepare a [master batch 1].

Example 1

378 parts of the low-molecular-weight polyester 1, 110 parts of synthetic ester wax (pentaerythritoltetrabehenate) and 947 parts of ethyl acetate were mixed in a reaction vessel including a stirrer and a thermometer to prepare a mixture. The mixture was heated to have a temperature of 80° C. while stirred. After the temperature of 80° C. was maintained for 5 hrs, the mixture was cooled to have a temperature of 30° C. in an hour. Then, 250 parts of a metallic material 1 (Table 1) and 750 parts of ethyl acetate were added to the mixture, and the mixture was mixed for 1 hr to prepare a [material solution 1]. 1,324 parts of the material solution 1 were transferred into another vessel, and a pigment and a wax thereof were dispersed by a beads mill (an ultra visco mill from Imecs Co., Ltd.) filled with zirconia beads having a diameter of 0.5 mm by 80 volume % on the condition of 3 passes at a liquid feeding speed of 1 kg/hr and a disk peripheral speed of 6 m/sec. Next, 1,324 parts of an ethyl acetate solution of the low-molecular-weight polyester 1 having a concentration of 65% were added to the material solution 1 and the mixture was milled by the beads mill at one time to prepare a [dispersion 1].

664 parts of the dispersion 1, 100 parts of the prepolymer 1 and 4.2 parts of the ketimine compound 1 were mixed in a vessel by a TK homomixer from TOKUSHU KIKA KOGYO CO., LTD. at 5,000 rpm for 1 min. Then, 1,200 parts of the aqueous phase were added to the mixture and mixed by the TK homomixer at 13,000 rpm for 20 min to prepare an emulsified slurry 1.

The emulsified slurry 1 was put in a vessel including a stirrer and a thermometer, and a solvent was removed therefrom at 30° C. for 8 hrs.

After the emulsified slurry 1 was filtered under reduced pressure, 100 parts of ion-exchanged water were added to the filtered cake and mixed by the TK homomixer at 12,000 rpm for 10 min, and the mixture was filtered.

Further, 100 parts of an aqueous solution of sodium hydrate having a concentration of 10% were added to the filtered cake and mixed by the TK homomixer at 12,000 rpm for 30 min, and the mixture was filtered under reduced pressure.

Furthermore, 100 parts of hydrochloric acid having a concentration of 10% were added to the filtered cake and mixed by the TK homomixer at 12,000 rpm for 10 min, and the mixture was filtered.

In addition, 300 parts of ion exchange water were added to the filtered cake and mixed by the TK homomixer at 12,000 rpm for 10 min, and the mixture was filtered twice to prepare a [filtered cake 1].

The filtered cake 1 was dried by an air drier at 45° C. for 48 hrs and sieved by a mesh having an opening of 75 μm to prepare toner particles. Each 0.5 parts of hydrophobic silica and hydrophobic titanium oxide were mixed with 100 parts of the toner particles by a Henschel mixer to prepare a [toner 1].

Example 2

The procedure for preparation of the toner 1 in Example 1 was repeated to prepare a [toner 2] except for replacing the metallic material 1 with a metallic material 2 (Table 1).

Example 3

The procedure for preparation of the toner 1 in Example 1 was repeated to prepare a [toner 3] except for replacing the metallic material 1 with a metallic material 3 (Table 1).

Example 4

The procedure for preparation of the toner 1 in Example 1 was repeated to prepare a [toner 4] except for replacing the metallic material 1 with a metallic material 4 (Table 1).

Example 5

The procedure for preparation of the toner 1 in Example 1 was repeated to prepare a [toner 5] except for replacing the metallic material 1 with a metallic material 5 (Table 1).

Example 6

The procedure for preparation of the toner 1 in Example 1 was repeated to prepare a [toner 6] except for replacing 250 parts of the metallic material 1 and 378 parts of the low-molecular-weight polyester 1 material 1 with 250 parts of the master batch 1 and 128 parts of the low-molecular-weight polyester 1.

Comparative Example 1

After 80 parts of comparative polyester 1 (including fumaric acid and trimellitic acid anhydride as acids and ethylene glycol and 1,6-hexanediol as alcohols), 20 parts of the metallic material 1 and 5 parts of synthetic ester wax were fully mixed in a Henschel mixer to prepare a mixture, the mixture was kneaded by a biaxial extruder upon application of heat, wherein the mixture was kneaded to have a temperature of 120° C. at an exit of the biaxial extruder. Then, the kneaded mixture was cooled, pulverized and classified to prepare toner particles. Each 0.5 parts of hydrophobic silica and hydrophobic titanium oxide were mixed with 100 parts of the toner particles by a Henschel mixer to prepare a [comparative toner 2].

Comparative Example 2

The procedure for preparation of the comparative toner 1 in Comparative Example 1 was repeated to prepare a [comparative toner 2] except for replacing the metallic material 1 with a metallic material 3.

Comparative Example 3

The procedure for preparation of the comparative toner 1 in Comparative Example 1 was repeated to prepare a [comparative toner 3] except for replacing the metallic material 1 with a metallic material 4.

Comparative Example 4

The procedure for preparation of the toner 1 in Comparative Example 1 was repeated to prepare a [comparative toner 4] except for replacing 80 parts of the comparative polyester 1 and 20 parts of the metallic material 1 with 60 parts of the comparative polyester 1 and 20 parts of the master batch 1.

Comparative Example 5

The procedure for preparation of the comparative toner 1 in Comparative Example 1 was repeated to prepare a [comparative toner 5] except for replacing the metallic material 1 with carbon black.

0.7 parts of hydrophobic silica and 0.3 parts of hydrophobic titanium oxide were mixed with 100 parts of each of the toner particles in Example 1 to 6 and Comparative Examples 1 to 5 by a Henschel mixer. A developer including 5% by weight of each of the toners treated with an external additive and 95% by weight of a copper-zinc ferrite carrier coated with a silicone resin, having an average particle diameter of 40 μm was prepared.

TABLE 1

| Metal material | Metal | Saturation magnetization | L* | a* | b* | Ti content (% by weight) | BET surface are ($m^2/g$) | True specific gravity ($g/cm^3$) |
|---|---|---|---|---|---|---|---|---|
| 1 | Fe, Mn, Cu, Ti | 2.0 | 17.0 | 0.1 | −0.2 | 11 | 18.0 | 4.3 |
| 2 | Mn | 0.7 | 12.1 | 0.2 | 0.0 | 0 | 45.0 | 4.6 |
| 3 | Fe, Ti | 11.5 | 9.5 | 0.0 | 0.2 | 27 | 18.0 | 4.3 |
| 4 | Fe, Ti | 20.4 | 18.7 | 0.2 | −0.1 | 47 | 1.3 | 3.8 |
| 5 | Fe, Cu | 76.0 | 15.1 | 0.1 | 0.3 | 0 | 14.0 | 4.3 |

The following evaluations were performed on each toner prepared in Examples 1 to 6 and Comparative Examples 1 to 5. The results are shown in Table 2.

a) Low-temperature Fixability

A solid image having an adhered amount of toner of 1.0±0.1 $mg/cm_2$ was produced by a copier imagio Neo 450 from Ricoh Company, Ltd. on a copy paper TYPE 6000 <70W> from Ricoh Company, Ltd., to measure a cold offset temperature changing a temperature of the fixing roller under the following fixing conditions:

a linear speed of the fixer of 180±2 mm/sec, and a fixing nip width of 10±1 mm.

The results were classified into 5 grades as follows:

5: less than 130° C.

4: from 130 to less than 140° C.

3: from 140 to less than 150° C.

2: from 150 to less than 160° C.
1: not less than 160° C.

b) Image Density

A solid image was produced by a copier imagio Neo 450 from Ricoh Company, Ltd., and image densities of 6 parts thereof were measured with a Macbeth densitometer and an average thereof was classified into the following 5 grades. An image density produced by a black toner using a marketed carbon black is level 2.

5: very high
4: high
3: normal
2: low
1: very low c) Background Fouling

A white image was produced after 1,000,000 images were produced to measure image densities of 6 parts thereof with a Macbeth densitometer, and an average thereof was classified into the following 5 grades. No background fouling has the same image density as that of a white paper, and the larger the worse.

5: very high
4: high
3: normal
2: low
1: very low d) Toner Scattering

A status of toner scattering in the copier after 1,000,000 images were produced was evaluated and classified into the following 5 grades. Toner scattering of a black toner using a marketed carbon black is level 2:

5: very high
4: high
3: normal
2: low
1: very low e) Thin Line Reproducibility

A 1 dot lattice line image was produced at 600 dot/inch and 150 line/inch both in the main and sub scanning directions, and the line image was visually evaluated to find a cut or a thin spot thereof and classified into the following 5 grades.

5: very high
4: high
3: normal
2: low
1: very low

TABLE 2

| | Low-temperature fixability | Image density | Background fouling | Toner scattering | Thin line reproducibility |
|---|---|---|---|---|---|
| Ex. 1 | 5 | 5 | 4 | 5 | 5 |
| Ex. 2 | 4 | 5 | 4 | 5 | 4 |
| Ex. 3 | 5 | 5 | 5 | 5 | 5 |
| Ex. 4 | 5 | 4 | 5 | 5 | 4 |
| Ex. 5 | 5 | 5 | 5 | 5 | 4 |
| Ex. 6 | 5 | 5 | 5 | 5 | 5 |
| Com. Ex. 1 | 4 | 3 | 3 | 4 | 4 |
| Com. Ex. 2 | 4 | 4 | 4 | 4 | 4 |
| Com. Ex. 3 | 4 | 3 | 4 | 4 | 3 |
| Com. Ex. 4 | 4 | 5 | 4 | 3 | 4 |
| Com. Ex. 5 | 3 | 2 | 2 | 2 | 2 |

This document claims priority and contains subject matter related to Japanese Patent Application No. 2003-188644 filed on Jun. 30, 2004, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

toner particles comprising:

a binder resin;

a colorant; and a particulate resin, wherein the toner particles are prepared by a method comprising:

dissolving or dispersing a composition comprising a modified resin capable of reacting with an active hydrogen, the colorant and a compound having an active hydrogen, in an organic solvent, to provide an oil phase liquid;

dispersing the oil phase liquid in an aqueous medium including the particulate resin while subjecting the modified resin to at least one member selected from the group consisting of crosslinking reactions and elongation reactions to provide the binder resin; to provide a dispersion;

removing the organic solvent from the dispersion to prepare the toner particles;

washing the toner particles; and drying the toner particles, wherein the colorant is a black metallic material.

2. The toner of claim 1, wherein the black metallic material has a saturation magnetization of from 0 to 50 emu/g.

3. The toner of claim 1, wherein the black metallic material has a lightness index L* not greater than 15, and chromaticness indices a* and b* of from −1.0 to +1.0 respectively, and wherein the lightness index L* and chromaticness indices a* and b* are determined by a method based on CIE1976.

4. The toner of claim 1, wherein the black metallic material is an iron oxide compound further comprising titanium.

5. The toner of claim 4, wherein the titanium is present in an amount of 10 to 45% by weight, based on total weight of iron in the black metallic material.

6. The toner of claim 1, wherein the black metallic material has a specific surface area of from 1.3 to 80 $m^2/g$.

7. The toner of claim 1, wherein the black metallic material has a true specific gravity of from 4.0 to 5.0 $g/cm^3$.

8. The toner of claim 1, wherein the toner comprises the black metallic material in an amount of from 10 to 50% by weight based on total weight of the toner.

9. The toner of claim 1, wherein the black metallic material has an average primary particle diameter of from 0.05 to 2.0 μm.

10. The toner of claim 1, wherein the modified resin is a modified polyester resin.

11. The toner of claim 1, wherein the binder resin comprises urea linkages.

12. The toner of claim 1, wherein the colorant is used in a form of a master batch prepared by a method comprising kneading a colorant with an unmodified resin in a solvent or water.

13. The toner of claim 1, wherein the toner has a weight-average particle diameter of from 4 to 8 μm and a ratio of the weight-average particle diameter to a number-average particle diameter of from 1.00 to 1.25.

14. The toner of claim 1, wherein the toner has an average circularity of from 0.940 to 0.995.

15. The toner of claim 1, wherein the toner further comprises a wax.

16. The toner of claim 1, wherein the toner further comprises a charge controlling agent.

17. A one-component developer comprising the toner according to claim 1.

18. A two-component developer comprising the toner according to claim 1 and a carrier.

19. A container containing the toner according to claim 1.

20. An image forming method comprising:

forming a latent image on a latent image bearer;

developing the latent image with a developer comprising a toner to form a toner image;

transferring the toner image onto a transfer material; and fixing the toner image on the transfer material upon application of heat, wherein the toner is the toner according to claim 1.

21. A process cartridge comprising:

an image bearer configured to form a latent image thereon; and an image developer configured to develop the latent image with a developer comprising a toner;

wherein the toner is the toner according to claim 1.

* * * * *